US010002726B2

(12) United States Patent
Wang et al.

(10) Patent No.: US 10,002,726 B2
(45) Date of Patent: Jun. 19, 2018

(54) MEMBRANE SWITCH AND METHOD OF MANUFACTURING THE SAME

(71) Applicant: KUNSHAN JOING TECHNOLOGY CO., LTD, Kunshan, Jiangsu (CN)

(72) Inventors: Yu Wang, Kunshan (CN); Zean Qiu, Kunshan (CN)

(73) Assignee: KUNSHAN JOING TECHNOLOGY CO., LTD, Kunshan (CN)

( * ) Notice: Subject to any disclaimer, the term of this patent is extended or adjusted under 35 U.S.C. 154(b) by 45 days.

(21) Appl. No.: 15/025,682

(22) PCT Filed: Mar. 7, 2014

(86) PCT No.: PCT/CN2014/073080

§ 371 (c)(1),
(2) Date: Mar. 29, 2016

(87) PCT Pub. No.: WO2015/109636

PCT Pub. Date: Jul. 30, 2015

(65) Prior Publication Data

US 2016/0240333 A1 Aug. 18, 2016

(30) Foreign Application Priority Data

Jan. 26, 2014 (CN) ..... 2014 1 0036203

(51) Int. Cl.
*H01H 1/10* (2006.01)
*H01H 13/704* (2006.01)
*H01H 13/88* (2006.01)

(52) U.S. Cl.
CPC ..... *H01H 13/704* (2013.01); *H01H 13/88* (2013.01); *H01H 2227/008* (2013.01);
(Continued)

(58) Field of Classification Search
CPC ..... H01H 13/704; H01H 13/88; H01H 2229/028; H01H 11/04; H01H 11/041;
(Continued)

(56) References Cited

U.S. PATENT DOCUMENTS 4,110,506 A * 8/1978 Cottingham ..... C09J 5/00 156/273.9
4,857,887 A * 8/1989 Iten ..... H03K 17/9643 200/512

(Continued)

FOREIGN PATENT DOCUMENTS

CN 1445805 A 10/2003
CN 101247707 A 8/2008

(Continued)

OTHER PUBLICATIONS

Oct. 27, 2014 International Search Report issued in International Patent Application No. PCT/CN2014/073080.

*Primary Examiner* — Edwin A Leon
*Assistant Examiner* — Lheiren Mae A Caroc
(74) *Attorney, Agent, or Firm* — Oliff PLC

(57) ABSTRACT

A membrane switch and a method of manufacturing the same, includes upper and lower membranes printed with upper and lower conductive dots and an isolation layer between them, holes being opened in the isolation layer corresponding to the dots, the isolation layer is bonded with the upper and lower membranes respectively via the glue coated on the upper surface and the lower surface thereof; and the glue may employ hot melt glue. This method of manufacturing the membrane switch includes a coating the upper surface and/or lower surface of the isolation layer exclusive of the positions of the holes with glue; bonding and adhering the sides of the upper membrane and the lower membrane printed with the conductive dots and respectively to the upper surface and the lower surface of the isolation
(Continued)

layer via glue, making the positions of the conductive dots and the holes corresponding to each other.

7 Claims, 1 Drawing Sheet

(52) U.S. Cl.
CPC . *H01H 2229/028* (2013.01); *H01H 2229/056* (2013.01); *H01H 2239/056* (2013.01)

(58) Field of Classification Search
CPC ..... H01H 11/06; H01H 2229/052; H01H 2229/056; Y10T 29/49105
USPC ..... 200/511–513
See application file for complete search history.

(56) References Cited

U.S. PATENT DOCUMENTS

| | | | | |
|---|---|---|---|---|
| 4,994,634 | A | 2/1991 | Tanji et al. | |
| 6,797,906 | B2 | 9/2004 | Ohashi | |
| 2003/0173201 | A1 | 9/2003 | Ohashi | |
| 2008/0230362 | A1* | 9/2008 | Hsu | H01H 13/705 200/512 |
| 2010/0163388 | A1* | 7/2010 | Yasuhara | H01H 13/88 200/5 A |

FOREIGN PATENT DOCUMENTS

| | | | |
|---|---|---|---|
| CN | 101409169 | A | 4/2009 |
| CN | 102148103 | A | 8/2011 |
| CN | 203055741 | U | 7/2013 |

* cited by examiner

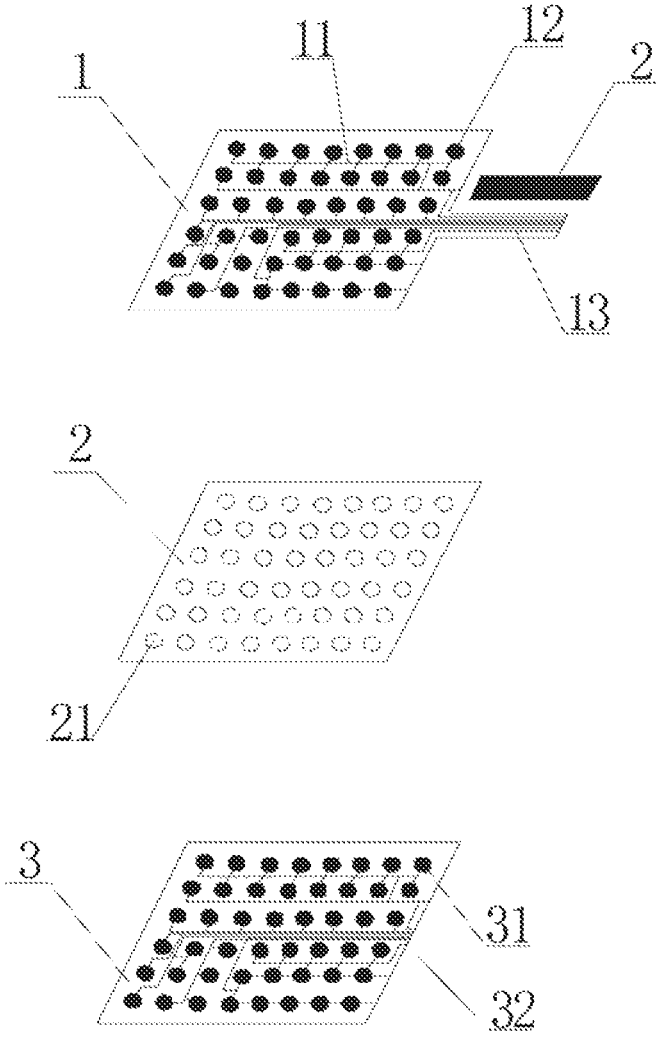
1
11
12
2
13
2
21
3
31
32

MEMBRANE SWITCH AND METHOD OF MANUFACTURING THE SAME

TECHNICAL FIELD

The present invention relates to the field of electronic switches, in particular to a manufacturing method of membrane switches for computer keyboards, keyboards of communications equipment and keyboards of household appliances, etc.

BACKGROUND OF INVENTION

With the continuous development of science and technology, varieties of electronic equipment have emerged in abundance. Keyboards are common devices of many electronic equipment, for inputting text information, etc., and commonly are computer keyboards, keyboards of communications equipment and keyboards of household appliances, etc. A membrane switch is a component of the aforesaid keyboards, the development of which now tends towards thin and tight designs, flexibility and low cost and which with advantages such as small size, light weight, simple to operation, etc. Membrane switches have been widely used in various products, for example intelligent electronic instruments, medical instruments, numerical control machine tools, communications equipment, office supplies, home appliances, computer keyboards, etc.

The structure of existing membrane switches mainly consists of three layers, that is, an upper circuit layer, a middle pad layer and a lower circuit layer, and these three layers are independent parts combined to form a membrane switch. The existing membrane switch usually uses materials such as Self-adhesive sticker or double-sided adhesive tape, etc. by screen printing to serve as the middle pad layer for isolation, where a specific mold must be used for holes punching to avoid button positions. However, the following problems are prone to occur in screen printing: uneven adhesive, poor close adaptation, and low product defect-free rate; the double-sided adhesive tape is easily deformed after punching and forming, easily wrinkles and is difficult for operation when bonding, and the membrane switch manufactured has poor waterproof and sealing performance and is easy to be oxidized and corroded, and thus resulting in the instability of the membrane switch.

The Chinese invention patent, Patent Application No. 201010111942.9, discloses a manufacturing method of a membrane switch including the following steps: (1) printing a conductive layer, where electrically conductive silver paste is printed on an upper membrane layer and a lower substrate layer to form an upper conductive layer and a lower conductive layer respectively; (2) printing a pad layer, where UV ink is used to form an UV pad layer by printing the pad layer through printing on the periphery of the key positions of the upper and lower conductive layers, which isolates the upper conductive layer from the corresponding lower conductive layer; (3) bonding the layers, where a glue layer is printed on the area of upper membrane corresponding to the periphery region of the pad of the UV pad layer, leaving the inner region of the UV spacer unprinted and then the glue layer bonds the upper membrane to the corresponding lower substrate layer. By this way, the glue layer bonds the upper membrane with the lower substrate layer at the periphery of the UV pad layer and the periphery of the membrane switch correspondingly to an entirety. Although this manufacturing method of a membrane switch is simple, practical and easy to operate, there is no glue to be printed on the UV pad layer is very difficult to achieve, due to that it is very apt to print the glue on the conductive layers after the upper membrane is printed with the glue and bonded with the UV pad layer, and then affect the contact between the upper and lower conductive layers. In addition, printing of the glue is likely to cause defects such as bubbles and hollow resulting in the membrane switch has quality problems.

SUMMARY

The present invention is intended to overcome the deficiencies of the prior art and provide a membrane switch with simple structure, low cost and in which the adhesive layer does not affect the contact between the upper and lower conductive dots, and a method of manufacturing the same.

To achieve the above purpose, the present invention on one aspect provides ta membrane switch including an upper membrane, a lower membrane and an isolation layer between the upper and lower membranes, a plurality of upper conductive dots and upper conductive traces connecting the upper conductive dots being printed on the undersurface of the upper membrane; lower conductive dots and lower conductive traces being printed on the upper surface of the lower membrane at the positions respectively corresponding to the upper conductive dots and the upper conductive traces; holes being opened in the isolation layer at the positions corresponding to the upper conductive dots and the lower conductive dots; the isolation layer is bonded with the upper membrane and the lower membrane respectively via glue coated on the upper surface and the lower surface thereof; and the glue being coated on the upper and/or lower surface is hot melt glue.

Preferably, the isolation layer is a PET membrane.

In a preferable embodiment, a thickness of the isolation layer is 30 μm-100 μm.

The present invention on the other aspect provides a method of manufacturing a membrane switch, including the following steps in turn:

(a) coating the upper surface and/or lower surface of the isolation layer exclusive of the positions of the holes with glue;

(b) bonding and adhering the sides of the upper membrane and the lower membrane printed with the conductive dots and traces respectively to the upper surface and the lower surface of the isolation layer via glue, making the positions of the conductive dots and the holes corresponding to each other, and forming a membrane switch by bonding the upper membrane and lower membrane both on the isolation layer via glue.

Preferably, in step (a), the glue coated employs hot melt glue, and is dried at 40-80° C. after coating to cure the hot melt glue.

Further, in the step (b), the upper membrane and the lower membrane are treated by hot roll-press after being bonded to the hot melt glue. More further, the temperature of the hot roll-press is 100° C.-200° C.

More further, the hot roll-press speed is 1 μm/s-1 cm/s.

More further, the pressure of the hot roll-press is 0.5 Mpa-5 Mpa.

Due to the use of the above technical solution, the present invention has the following advantages when compared with the prior art: by coating the glue on the upper and lower surfaces of the isolation layer and thereby bonding with the upper membrane and the lower membrane, the membrane switch according to the present invention can effectively overcome defects such as bubbles, bulges, lack of glue and the like caused by the conventional printing process, prevent liquid glue from lose efficacy and simplify the membrane-switch production process; and the glue on the upper and/or lower surfaces of the isolation layer employing hot-melt glue may increase the degree of automation and reduce human costs.

BRIEF DESCRIPTION OF DRAWINGS

FIG. 1 is a structure schematic diagram of a membrane switch according to an embodiment of the present invention;

Wherein, 1. upper membrane; 11. upper conductive dot; 12. upper conductive trace; 2. isolation layer; 21 hole; 3. lower membrane; 31. lower conductive dot; 32 lower conductive trace.

DETAILED DESCRIPTION OF EMBODIMENTS

In the following, the preferable embodiments of the present invention are explained in detail combining with the accompanying drawings.

Embodiment 1

The membrane switch shown in FIG. 1 mainly includes an upper membrane 1, an isolation layer 2 and a lower membrane 3, the isolation layer 2 being located between the upper membrane 1 and lower membrane 2. Two opposite surfaces of the upper membrane 1 and the lower membrane 3 (that is, the undersurface of the upper membrane 1 and the top surface of the lower membrane 3) are respectively printed with upper conductive dots 11 and upper conductive traces 12 connecting the upper conductive dots 11 as well as lower conductive dots 31 and conductive traces 32, positions of the upper conductive dots 11 and the lower conductive dots 31, and the positions of the upper conductive traces 12 and the lower conductive traces 32 match up with and correspond to each other. Holes 21 are provided in the isolation layer 2 at the positions corresponding to the upper conductive dots 11 and the lower conductive dots 31. Glue is coated on the upper and lower surfaces of the isolation layer 2 to bond the isolation layer 2 with the upper membrane 1 and lower membrane 3. This coating process can overcome defects such as bubbles and bulges, etc., caused by the conventional printing process. In addition, coating the upper and lower surfaces of the isolation layer 2 is easy to operate and beneficial to simplify the membrane-switch production process. The glue on the upper and/or lower surfaces of the isolation layer 2 is hot-melt glue, and thus coating can carried through by machines, and bonding by hot-pressing, which increases the degree of automation and reduces human costs. In addition, when compared with the conventional liquid glue, the hot melt glue has less smell, and may be able to improve the workshop environment.

In this embodiment, the isolation layer 2 is an insulation layer, which can prevent electrical contact and resulted short-circuit between the upper conductive traces 12 and the lower conductive traces 32. The isolation layer 2 preferably is PET (polyethylene terephthalate) film, which has well heat resisting property and ageing resistant performance, and can prolong the service life of the membrane switch. Thickness of the isolation layer 2 is preferably from 30 μm to 100 μm, facilitating the contact between the upper conductive dots 11 and lower conductive dots 31 made from conductive silver paste.

Embodiment 2

The present embodiment provides a method of manufacturing a membrane switch, including the following steps:

(a) coating the upper surface and/or lower surface of the isolation layer exclusive of the positions of the holes with glue;

(b) bonding and adhering the sides of the upper membrane and the lower membrane printed with the conductive dots and traces respectively to the upper surface and the lower surface of the isolation layer via glue, making the positions of the conductive dots corresponding to each other, and forming a membrane switch by bonding upper membrane and lower membrane both on the isolation layer via glue.

In this embodiment, the specific steps of the method of manufacturing a membrane switch have a great degree of freedom. One surface of the isolation layer may firstly be coated with glue and bonded with one of the upper membrane and lower membrane, and then the other surface of the isolation layer is coated with glue and bonded to the other one of the lower membrane and upper membrane. Or both two surfaces of the isolation layer are coated with glue simultaneously, and then bonded with the upper membrane or the lower membrane. The membrane switch is formed once both the upper and lower membranes are boned to the isolation layer via the glue layer. By coating the glue on the upper surface and/or lower surface of the isolation layer, it can greatly simplify the glue coating process and may avoid coating the glue to the conductive dots and traces and avoid the contact between the upper and lower conductive layers, thus enhancing the product quality of membrane switches. In addition, this coating process can overcome defects such as bubbles and bulges, etc., caused by the conventional printing process.

If the glue described in Embodiment 1 is a hot melt glue, after being coated with the hot-melt glue, both two surfaces of the isolation layer may be dried at 40-80° C. to cure the hot melt glue. In addition, after being bonded on the glue, the side of the upper membrane and the lower membrane printed with the conductive dots and conductive traces may be treated with hot roll-press by hot roll pressing press, and the hot roll-press temperature should not exceed the softening point of the membrane material used, and preferably is 100° C.-200° C.; the hot roll-press speed preferably is 1 μm/s-1 cm/s; and the hot roll-press pressure preferably is 0.5 Mpa-5 Mpa, such that the hot melt glue is heated sufficiently to bond the upper membrane, the isolation layer and lower membrane together, and thus the membrane switch has a good sealing performance. This is beneficial to increase the degree of automation, reduce human costs and improve the competitiveness of an enterprise.

The embodiments described above are only for illustrating the technical concepts and features of the present invention, and intended to make those skilled in the art being able to understand the present invention and thereby implement it, and should not be concluded to limit the protective scope of this invention. Any equivalent variations or modifications according to the spirit of the present invention should be covered by the protective scope of the present invention.

What is claimed is:

1. A method of manufacturing a membrane switch, the method comprising:

coating an upper surface and a lower surface of an isolation layer, exclusive of positions of holes within the isolation layer, with hot melt glue;

adhering and bonding an undersurface of an upper membrane and an upper surface of a lower membrane to the upper surface and the lower surface of the isolation layer, respectively, via the hot melt glue so that (i) the isolation layer is between the upper membrane and the lower membrane, (ii) upper conductive dots and upper conductive traces connecting the upper conductive dots printed on the undersurface of the upper membrane correspond with lower conductive dots and lower conductive traces printed on the upper surface of the lower membrane, and (iii) the holes within the isolation layer are at positions corresponding to the upper conductive dots and the lower conductive dots; and treating the upper membrane and the lower membrane by hot roll-press after being bonded to the isolation layer via the hot melt glue to form the membrane switch.

2. The method of manufacturing the membrane switch according to claim 1, wherein the hot melt glue is dried at 40-80° C. after coating to cure the hot melt glue.

3. The method of manufacturing the membrane switch according to claim 1, wherein the temperature of the hot roll-press is 100° C.–200° C.

4. The method of manufacturing the membrane switch according to claim 1, wherein the hot roll-press speed is 1 μm/s-1 cm/s.

5. The method of manufacturing the membrane switch according to claim 1, wherein the pressure of the hot roll-press is 0.5 Mpa-5 Mpa.

6. The method of manufacturing the membrane switch according to claim 1, wherein the isolation layer is a PET membrane.

7. The method of manufacturing the membrane switch according to claim 1, wherein the thickness of the isolation layer is 30 μm-100 μm.

* * * * *